United States Patent [19]

Hamilton, deceased

[11] 4,036,196

[45] July 19, 1977

[54] SPRING LOADED LEVER TO OPERATE CONTROL RACK OF FUEL INJECTOR

[75] Inventor: William I. Hamilton, deceased, late of Chicago Heights, Ill., by Edna L. Hamilton, joint tenancy for the estate

[73] Assignee: Allis-Chalmers Corporation, Milwaukee, Wis.

[21] Appl. No.: 607,602

[22] Filed: Aug. 25, 1975

[51] Int. Cl.[2] ..... F02D 1/04

[52] U.S. Cl. ..... 123/140 R; 417/286

[58] Field of Search .... 123/140 R, 139 AK, 139 AR, 123/139 AD, 139 AE; 417/286, 429

[56] References Cited

U.S. PATENT DOCUMENTS

| | | | |
|---|---|---|---|
| 1,497,258 | 6/1924 | Beals | 123/139 AK |
| 2,106,920 | 2/1938 | Rosen | 123/140 R |
| 2,407,610 | 9/1946 | Kammer | 123/139 R X |
| 2,587,376 | 2/1952 | Pelly et al. | 123/140 R X |
| 3,638,628 | 2/1972 | Stolworthy | 417/286 X |

*Primary Examiner*—Carroll B. Dority, Jr.
*Assistant Examiner*—Tony M. Argenbright
*Attorney, Agent, or Firm*—Arthur L. Nelson

[57] ABSTRACT

A mechanism to operate control racks for a plurality of unit injectors responsive to a governor control shaft and including spring loaded levers for driving the control racks with a positive action to increase the fuel rate and spring loaded fuel shut-off.

8 Claims, 8 Drawing Figures

SPRING LOADED LEVER TO OPERATE CONTROL RACK OF FUEL INJECTOR

This invention relates to fuel injection and more particularly to a mechanically operated governor control shaft to provide positive increase of fuel rate and spring loaded return of the control levers operating the control racks of a plurality of unit fuel injectors.

The conventional diesel engine incorporates a fuel control lever which is usually one piece resulting in positive motion in both fuel-on and fuel-off directions. In the event of a jammed plunger or injector rack in one of the unit injectors all injector racks became inoperative simultaneously. Accordingly, it is desirable to shut down the engine if one of the unit injector racks seizes, since a runaway engine could destroy itself or injure anybody in the vicinity of the engine.

This invention provides a means whereby the remaining fuel injectors which are not inoperative can be shut off. A spring loaded governor lever makes it possible to effectively disconnect a defective injector from the governing system so that fuel to the other cylinders can be reduced or stopped completely. With the spring loaded design, when one of the injector plungers is stuck, it will still be impossible to increase the fuel flow from the others. However, it would now be possible to shut the engine down because the spring on the stuck injector arm would allow the governor shaft to move and stop the fuel delivery from the other injectors. This provides a safe operating condition of the engine since the engine is effectively shut down when the fuel is cut off to the remaining fuel injectors.

Accordingly, it is an object of this invention to provide spring loaded racks for unit injectors with a positive opening action and spring loaded return.

It is another object of this invention to provide a fuel injection control for operating a plurality of unit injectors with a positive fuel increase on all injectors and spring-operated decrease in the fuel quantity and allow fuel shut off on all injectors but the one which may be defective.

It is a further object of this invention to provide a governor controlled arm with a positive increase in fuel injection and spring return to allow the engine to shut off in the event that one of the plurality of plungers in the unit injectors is jammed and thereby provide a safe operating condition for the engine.

The objects of this invention are accomplished by connecting to a governor-controlled shaft a linkage including a lever which has a positive drive to increase fuel injection in response to the governor operation or in response to a manual control. The increase in fuel injection is accomplished through a positive drive from the shaft to a lever driving a control rack on each of the fuel injectors. A spring-operated return on the lever will permit decrease in the quantity of fuel injection on each of the fuel injectors in response to the spring loaded return on the lever. In the event that one of the plungers is jammed it is impossible to increase the fuel quantity injected on this plunger and all other plungers of the unit injectors for the engine. It is, however, possible to decrease the fuel injection on all injectors except the one which is defective. The spring loaded lever makes it possible to effectively disconnect a defective injector from the governing system so that the fuel to the other cylinders can be reduced or stopped completely.

The preferred embodiments of this invention are illustrated in the attached drawings.

Figures 1, 2, 3:
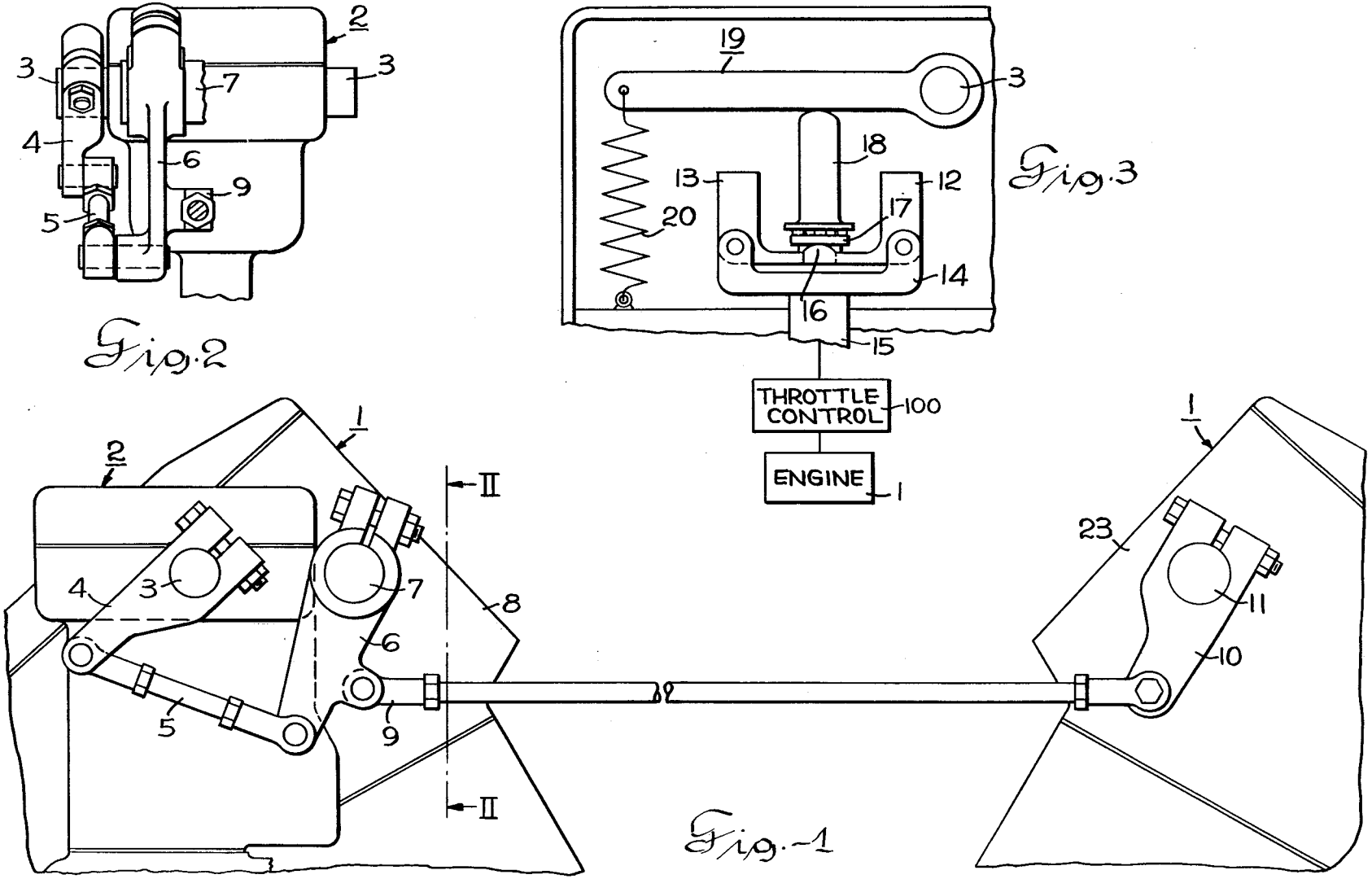
FIG. 1 illustrates the linkage between the governor and the shafts for driving the plurality of unit fuel injectors.
FIG. 2 is a side view of the linkage for driving the fuel injectors taken along lines II—II of FIG. 1.
FIG. 3 is a schematic view showing a flyweight governor connected to the speed adjusting shaft.

Referring to the drawings, FIG. 1 illustrates a V-8 engine 1 carrying an engine driven governor 2 driven in proportion to engine speed. The governor drives a speed adjusting shaft 3 carrying the governor lever 4. The governor lever 4 operates the link 5 which is connected to the governor control shaft lever 6 mounted from the governor control shaft 7. The governor control shaft lever 6 for the left bank 8 is pivotally connected through the connecting arm 9 which is also pivotally connected to the right bank governor control shaft arm 10. Left bank governor control lever 6 operates a governor control shaft 7 as well as the right bank governor control shaft lever 10 which is mounted on the right bank governor control shaft 11. FIG. 2 shows a side view of the governor 2 and the speed adjusting shaft 3 mounted on the engine 1. The speed adjusting shaft 3 is connected to the governor lever 4. The governor lever 4 connected to the link 5 operates the left bank governor control shaft lever 6 and the governor control shaft 7.

FIG. 3 is a schematic illustration of the governor operating the speed adjusting shaft 3. The flyweights 12 and 13 are mounted on the yoke 14 carried on shaft 15 which is connected through the throttle control 100 to the engine and is driven proportionately to engine speed. A flyweight toe 16 bears against the thrust bearing 17 and presses the shaft 18 against the lever 19 connected to the speed adjusting shaft 3. The spring 20 normally biases the flyweights to a radially inner position as shown. The flyweights 12 and 13 are forced radially outward by centrifugal force as speed of the engine increases causing the lever 19 to pivot on the speed adjusting lever 3. The speed adjusting shaft 3 rotates in a clockwise direction as the speed of the engine increases.

Figure 4:
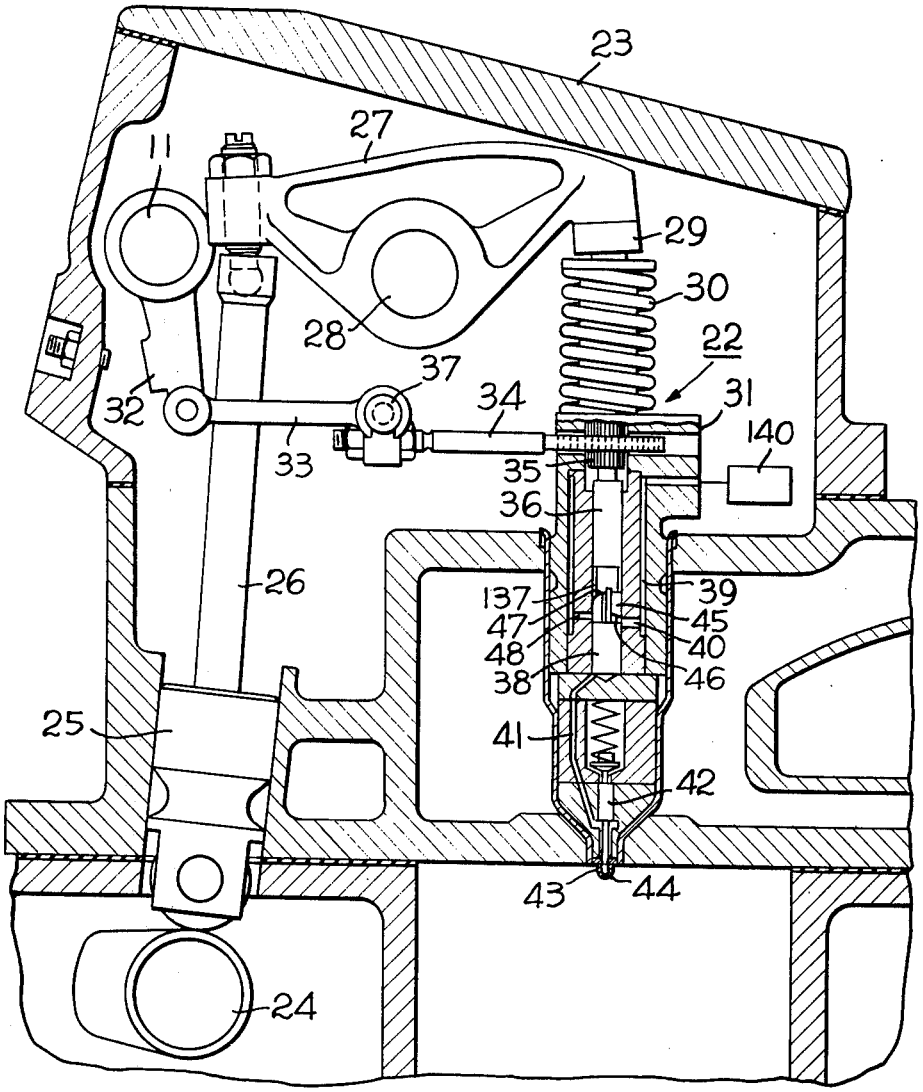
FIG. 4 is a cross section view of the engine showing the cam drive mechanism for the unit fuel injector and the control rack driven by the governor controlled lever.

FIG. 4 illustrates the governor control shaft 11 for the right bank 23 supporting the injection control arm 32. The fuel injector 22 is shown in the intermediate fuel injection position when the engine is running at an intermediate speed. As the governor speed increases the fuel injector increases the amount of fuel metered and injected into the combustion chamber. Increase in governor speed causes the governor lever 4 to rotate in a clockwise direction which also rotates the right bank and left bank governor control shaft levers 10 and 6 to rotate in a clockwise direction. The governor control shaft 11 shown in FIG. 4 operates the fuel injection of the fuel injector 22.

The right bank 23 of the engine is shown in cross section in FIG. 4. A cam shaft 24 is driven by the engine which operates the lifter 25 and pushrod 26. The pushrod 26 operates the rocker arm 27 which is pivotally mounted on the rocker shaft 28. This in turn operates the plunger 29 against the follower spring 30. The fuel injector holder 31 supports the fuel injector on the engine. The injection control arm 32 mounted on the right bank governor control shaft 11 operates the link 33 which is connected to the fuel injection control rack 34. Fuel injection control rack 34 drives the pinion 35 on the plunger 36. The plunger 36 is driven by the follower 29. The link 33 and the rack 34 are connected by a ball pivot joint 37. Likewise the link 5 and arm 9 have ball joint connections to drive the connecting levers.

The plunger 36 reciprocates within the barrel 137 which forms the high pressure chamber 38. The fuel supply passage 39 is connected to a supply tank 140. The fuel supply passage 39 is connected by the port 40 to the high pressure chamber 38. High pressure chamber 38 supplies fuel to the passage 41 to the differential valve 42 and the nozzle 43. The fuel is injected through the orifices 44 into the compression chamber.

The plunger 36 forms the land 45 having a leading edge 46 to initiate fuel injection and a trailing edge 47 to terminate fuel injection when it registers with the port 48. When the plunger 36, as viewed from the top, is rotated in a clockwise direction fuel injection quantity is increased and similarly decreased when rotated in the counterclockwise direction.

Figure 6:
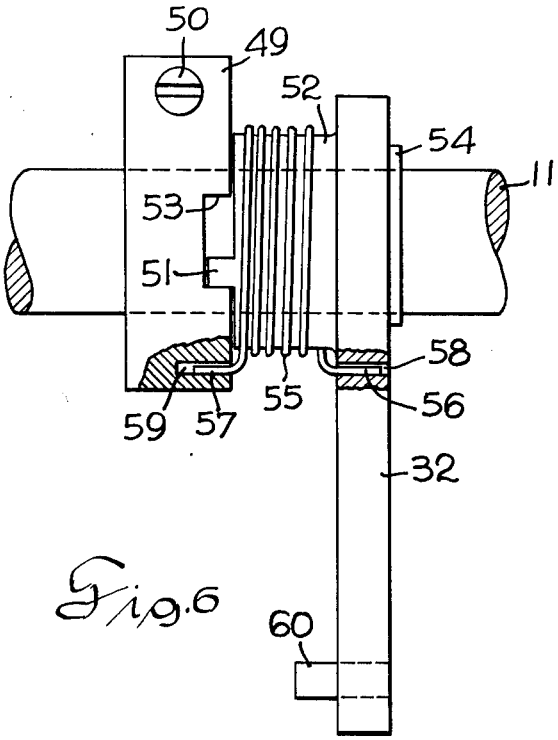
FIG. 6 is a side view of the spring loaded lever as shown in FIG. 5.
Figure 5:
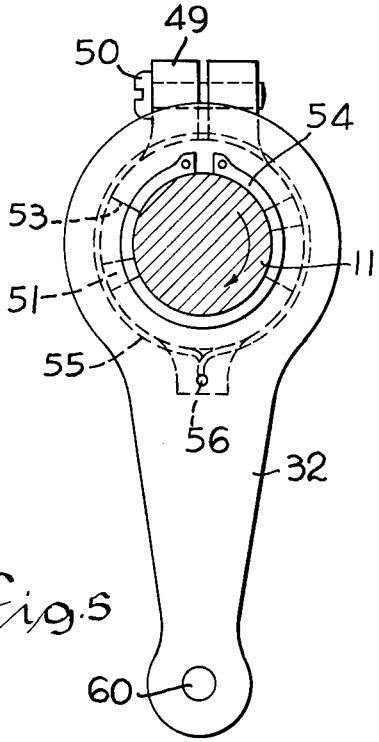
FIG. 5 illustrates a spring loaded lever for operating the control rack of the unit fuel injector.

A governor control shaft 11, shown in FIG. 4, is for the right bank of the engine; similarly the left bank governor control shaft 7 operates fuel injection in a similar manner which is subsequently described. The right bank governor control shaft 11 is provided with a lever 32. FIGS. 5 and 6 show one embodiment for the lever to provide a spring loaded injection control lever as shown in the right bank governor control shaft 11 carried on the lever 32. A split collar is tightened to a fixed position by means of the locking screw 50. A lug 51 on the sleeve portion 52 of lever 32 engages the side of the slot 53 when fuel is increased. The snap ring 54 holds the lever 32 with the lug 51 in the slot 53. The lever is spring loaded to decrease quantity of fuel injection. The spring 55 has a stem 56 and a stem 57 on opposite ends for engaging a hole 58 in the lever 52 and also hole 59 in the split collar 49. Lever 32 receives a pin 60 for connection to the link 33.

Figure 8:
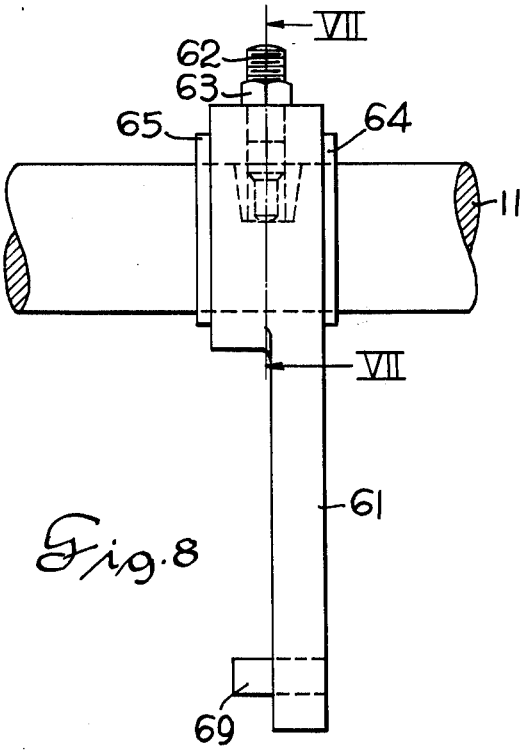
FIG. 8 is a side view of the spring loaded lever for operating the unit fuel injector as shown in FIG. 7.
Figure 7:
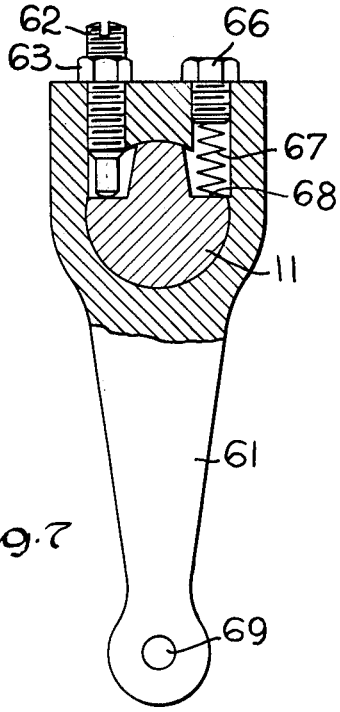
FIG. 7 is a modification of the spring loaded lever shown in cross section for operating a control rack for a unit fuel injector taken along lines VII—VII of FIG. 8.

FIGS. 7 and 8 illustrate a modification of the governor control shaft lever construction. The governor control shaft 11 carries the injection rack control lever 61 and is locked by the adjusting screw 62 and lug nut 63 for adjusting the control arm setting. The snap rings 64 and 65 retain the axial position of the control lever 61. The bolt 66 engages the compression spring 67 which engages a flat surface 68 on the governor control shaft 11. A pin 69 is pivotally connected to the injector rack.

The operation of the device will be described in the following paragraphs.

The throttle control manually presets the engine speed. The governor 2 is engine driven and drives at a speed in proportion to the speed of the engine. The governor speed adjusting shaft 3 of the governor drives the governor lever 4 which in turn drives the left bank governor control shaft lever 6 and the right bank governor control shaft lever 10. The right bank governor control shaft 11 extends into the head of the right bank of the engine and engages the injection rack control lever 32. The drive from the governor to the right bank governor control shaft 11 is in positive drive. The right bank governor control shaft lever 32 is a spring loaded lever which drives the link 33 and the rack 34 in the lefthand direction in a positive manner to increase fuel injection. The control rack 34 drives the pinion 70 in a clockwise direction when viewed from above the fuel injector 22. This causes the land 45 to rotate whereby the leading edge 46 of the land 45 closes the port 40 at an earlier time in the cycle. Likewise the trailing edge 47 of the land 45 closes fuel injection at a later point in time and a greater quantity of fuel is injected with an increased speed of the governor.

Decrease in the fuel injection quantity is caused by decrease in the governor speed. When the engine speed and the governor speed decreases the speed adjusting shaft 3 rotates in a counterclockwise direction as shown in FIG. 1. This in turn rotates the left bank and right bank governor control shafts 7 and 11 in a counterclockwise direction and the injection rack control lever 32 as well. With a counterclockwise direction of the injection control lever 32 the link 33 and rack 34 move in the right hand direction. Referring to the lever 32, as shown in FIGS. 4 and 5, the coil spring 55 biases the lever in the counterclockwise direction to rotate the pinion 35 in a counterclockwise direction and decrease the quantity fuel injection.

In event that one of the fuel injectors is stuck the throttle can be brought to a shut-off position and all the fuel rack control levers will be brought to the shut-off position. The one lever with the jammed fuel injector will torque the spring 55 and will be unable to shut off this fuel injector. However, with the remaining fuel injectors being in the shut-off position the engine will effectively be shut off since it is not likely to run on a single cylinder.

This type of device provides a measure of safety since the engine can be shut of even though one of the fuel injectors is stuck. This is not normally true in the conventional type fuel injection system.

The embodiments of the invention in which an exclusive property or privilege is claimed are defined as follows:

1. A fuel injection control on a diesel engine for controlling a plurality of fuel injectors comprising, an engine driven governor, a speed responsive member driven by said governor responsive to engine speed, a plurality of fuel injectors each including a fuel injection plunger, a fuel injection control rack, a metering pinion on each of said fuel injection plungers for metering fuel injection, means defining a fuel injection pump including said fuel injection plunger defining a land forming at least one helical edge and a port to selectively vary quantity of fuel injection in response to rotation of said plunger, at least one governor control shaft, a collar defining an axial slot mounted on said control shaft, a fuel injection control arm mounted on said governor control shaft and connected to said fuel injection control rack, said control arm defining a lug received in said slot, said lug defining an angular width of less than the width of said slot to provide a lost motion connection between said collar and said lug, resilient means resiliently biasing said lug for an engaging position on one side of said slot to provide positive increase of quantity of fuel injection and permitting relative movement between said governor control shaft and control arm when fuel quantity is decreased.

2. A fuel injection control of a diesel engine for controlling a plurality of fuel injectors as set forth in claim 1 wherein said plurality of injectors define unit fuel injectors.

3. A fuel injection control on a diesel engine for controlling a plurality of fuel injectors as set forth in claim 1 wherein said fuel injector plunger defining a leading edge for initiating fuel injection and a trailing edge for terminating fuel injection.

4. A fuel injection control on a diesel engine for controlling a plurality of fuel injectors as set forth in claim 1 wherein said lost motion connection includes screw means to adjustably calibrate initiation of fuel injection.

5. A fuel injection control on a diesel engine for controlling a plurality of fuel injectors comprising, an engine driven governor, a speed responsive member driven by said governor responsive to engine speed, a plurality of fuel injectors each including a fuel injection plunger, a fuel injection control rack, a metering pinion on each of said fuel injection plungers for metering fuel injection, means defining a fuel injection pump including said fuel injection plunger defining a land forming at least one helical edge and a port to selectively vary quantity of fuel injection in response to rotation of said plunger, at least one governor control shaft defining a first and a second flat surface on said governor control shaft and connected to said fuel injection control rack, said control arm defining adjustable means engaging the first of said flat surfaces for positive increase of quantity of fuel injection, resilient means engaging the second of said flat surfaces to decrease the quantity of fuel injection and thereby assure individual decreasing fuel control on each of said fuel injectors in response to operation of said governor control shaft.

6. A fuel injection control on the diesel engine for controlling a plurality of fuel injectors as set forth in claim 5 including means for adjustably positioning said injection control arm for calibration of fuel injection timing on said governor control shaft.

7. A fuel injection control on a diesel engine for controlling a plurality of fuel injectors as set forth in claim 5 including calibration means in said adjustable means.

8. A fuel injection control on a diesel engine for controlling a plurality of fuel injectors as set forth in claim 5 including screw means adjustably calibrating fuel injection timing.

* * * * *